US006053807A

United States Patent [19]

Metzger et al.

[11] Patent Number: 6,053,807

[45] Date of Patent: Apr. 25, 2000

[54] APPARATUS FOR SEPARATING FOREIGN MATTER FROM COINS OR SIMILAR DISK-LIKE OBJECTS

[75] Inventors: Rolf Metzger, Waghausel; Thomas Meisenzahl, Rheinstetten, both of Germany

[73] Assignee: Standardwerk Eugen Reis GmbH & Co., Bruchsal, Germany

[21] Appl. No.: 09/036,176

[22] Filed: Mar. 6, 1998

[30] Foreign Application Priority Data

Mar. 10, 1997 [DE] Germany ..... 197 09 515

[51] Int. Cl.[7] ..... G07D 1/00; G07F 1/04

[52] U.S. Cl. ..... 453/57; 194/347

[58] Field of Search ..... 453/5, 9, 56, 57, 453/6, 10; 194/347, 348, 349, 200

[56] References Cited

U.S. PATENT DOCUMENTS

| | | | |
|---|---|---|---|
| 2,487,163 | 11/1949 | Miconi | 453/9 |
| 3,621,854 | 11/1971 | Redman | 453/9 |
| 3,965,912 | 6/1976 | Gross | 453/56 |
| 5,016,397 | 5/1991 | Higginbotham | 453/63 |
| 5,027,937 | 7/1991 | Parish et al. | 194/348 |
| 5,620,079 | 4/1997 | Molbak | 194/217 |

FOREIGN PATENT DOCUMENTS

| | | |
|---|---|---|
| 0355061 | 2/1990 | European Pat. Off. . |
| 2902716 | 3/1981 | Germany . |

*Primary Examiner*—Robert P. Olszewski
*Assistant Examiner*—Bryan Jaketic
*Attorney, Agent, or Firm*—Baker & Daniels

[57] ABSTRACT

Apparatus for processing coins or similar disk-like objects having a coin hopper, a coin tray that transfers the coins individually to a counting and/or sorting section and an inclined conveyor disposed between the hopper and the tray in order to feed coins to the coin tray. The tilt of the conveyor causes larger foreign objects to slide down the conveyor in a direction opposite to the feed direction, and the conveyor may include a coin singularizing stripper near its delivery end. A chute extends between the delivery end of the conveyor and the coin tray and the chute is perforated in order to separate coins from smaller foreign objects.

9 Claims, 2 Drawing Sheets

APPARATUS FOR SEPARATING FOREIGN MATTER FROM COINS OR SIMILAR DISK-LIKE OBJECTS

The present invention relates to an apparatus for processing, i.e., counting and/or sorting, coins or similar disk-like objects wherein the coins are fed via a coin hopper to a coin tray that transfers them individually and successively to a counting and/or sorting section.

Apparatuses of this type have been long known, see for example DE 29 02 716 B2, and, by and large, also have proven themselves and found acceptance. In view of the coin handling shifting from the banking establishment in a narrower sense to the customer, entirely new and entirely different problems present themselves. While at a banking establishment it can generally be assumed that the coins processed and to be processed are denominationally clean, this cannot be assumed for coin handling in the "field."

EP 03 55 061 A2 relates to a coin sorting and counting apparatus where the coins are placed in a coin caddy and cleaned prior to being fed to the coin sorting station.

It happens time and again that "coins" entered in an apparatus for counting and/or sorting contain not only coins (along with foreign or counterfeit coins, as the case may be), but that they are pervaded with all sorts of foreign objects, staples and paper clips up to stones, screws and nuts or the like. "Bulk coins" contain many large and small foreign objects, and it is readily conceivable that these are able to significantly disturb the proper counting and/or sorting operation. To make things worse yet, it also happens that a customer places a beverage on the machine and inadvertently spills it in the funnel described hereafter as the coin hopper.

Hence, the objective underlying the present invention consists in proposing an apparatus where, with respect to the above problems, provisions have been made for removing foreign objects and foreign matter as well as liquids in a specific way.

This objective is satisfied by providing between the coin hopper and coin tray the combination of an inclined conveyor, a stripper, such as a stripper roll, and a chute. The coin hopper empties the coins onto the inclined conveyor whereby the tilt thereof causes larger foreign objects to slide down opposite to the feed direction of the coins. The stripper is coordinated with the delivery end of the inclined conveyor such that the coins presented by the inclined conveyor are singularized, and the chute is designed and integrated between the delivery end of the inclined conveyor and the coin tray such that the coins fed into the coin tray from the conveyor are separated from smaller foreign objects which the inclined conveyor has advanced past the stripper.

In other words, the core of the present invention consists in not allowing the coins to proceed directly to the coin tray, but to load them first on a feed section suitable to separate interfering foreign objects and foreign matter, thereby ensuring that the counting and sorting operation will not be disturbed.

The details of two exemplary embodiments of the invention are illustrated more fully with the aid of the drawings, which show in:

Figure 1:
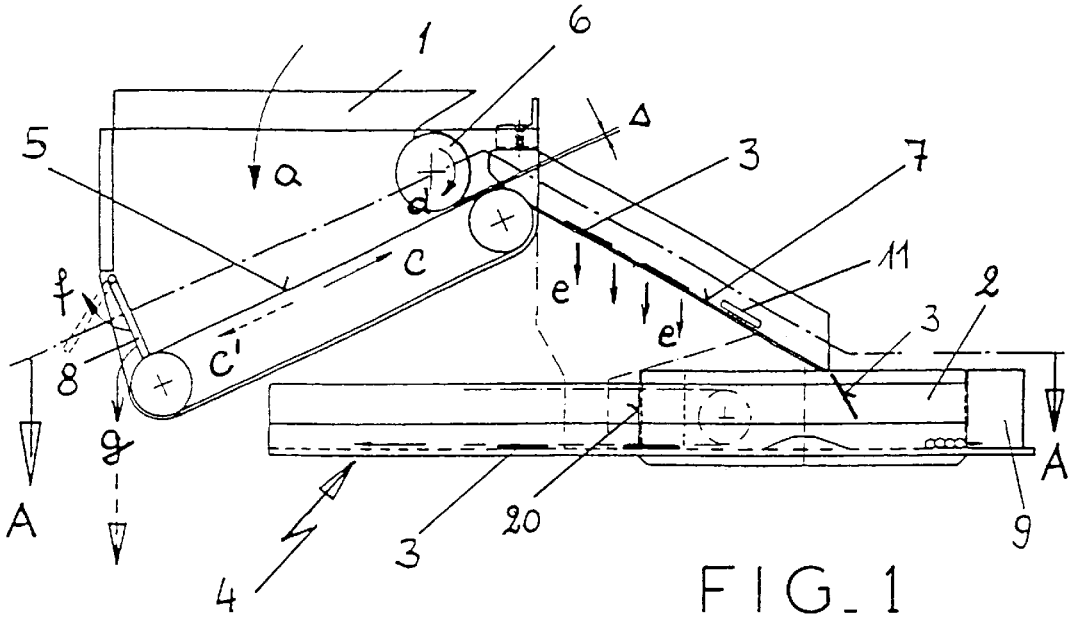
FIG. 1, is a schematic illustration of a coin processing apparatus in a side elevational view.

FIG. 1 is a basic illustration of the apparatus for processing, i.e., counting and/or sorting coins, the basic structural elements of which are a coin hopper 1 and a rotating horizontal coin tray 2. According to the relevant prior art, the coin mix to be counted and/or sorted is poured (arrow a) in the coin hopper 1 along with everything else mixed in the way of foreign objects and foreign substances, and proceeds from here to the coin tray 2, where a rotary motion is imparted to the coins 3 (arrow b). The coin tray 2 features a circumscribing skirting, or circular sidewall, 20 which, for one, has an approximately tangentially oriented exit recess through which the coins 3, mutually spaced, are individually and successively transferred or deflected, due to their centrifugal force, to a tangentially following control or guide section 4. Along the control or guide section 4 the loaded coins 3 are identified and/or counted and sorted, as the case may be. If in the process foreign or counterfeit coins are recognized, ample solutions are known according to the prior art for separating such foreign or counterfeit coins.

When used directly by customers, the "denominational cleanliness" of the coin mix to be processed deteriorates increasingly; all manner of foreign matter and foreign objects are dumped in the coin hopper 1 along with the coin mix, and it is not surprising that disturbances increase. The coin processing apparatus of the present invention presented here, hence, is ultimately expected to be able to sort and/or count a coin mix contaminated with all sorts of foreign objects and foreign matter, without failing time and again.

The basic solution is that no longer is the coin mix transferred directly from the coin hopper 1 to the coin tray 2, because a so-called cleansing, or cleaning, section is integrated between the two functional units of coin hopper and coin tray. In its basic structure, this cleansing/cleaning section is composed of an inclined conveyor 5, stripper 6 and chute 7, which are arranged and mutually coordinated and adapted to one another in a synergistic working and operating mode. The inclined conveyor 5 is mounted beneath coin hopper 1 which, in its function as a filling funnel, receives the entire coin mix. The conveyor itself is controlled such that the belt surface near the coin hopper 1 feeds from its low end to its high end (arrow c). More or less singularized, the coins are fed in the direction of arrow c to the top of the inclined conveyor 5, whereas irregularly shaped foreign objects and foreign matter slide or roll, due to their dead weight, to the bottom end of the inclined conveyor 5.

Coordinated with the top end of the inclined conveyor 5, i.e., its delivery end, is a stripper, notably in the form of a rotating stripper roll 6, which serves to deny passage to thicker objects, or foreign objects, which are thicker than the thickest coin of the denomination being processed. Thus, the stripper 6 is disposed opposite the surface of the inclined conveyor 5 with a clearance $\Delta$ corresponding to the thickness of the thickest coin occurring. Generally, this also assures that, e.g., two superjacent coins will not be drawn from the delivery end of inclined conveyor 5. The direction of rotation (arrow d) of the stripper roll 6 is opposite to the feed direction C of the inclined conveyor 5.

Coordinated with the delivery end of the inclined conveyor 5 is a downward chute 7 by way of which the coins 3 slide into the coin tray 2 as they are fed successively by the inclined conveyor 5 past the stripper 6. The chute 7 is fashioned as a perforated plate or the like, so that small foreign objects such as sand or the like that have passed the stripper 6 can drop through the holes (arrow e) and only coins 3 proceed to the coin tray 2.

For the sake of completeness it is noted that separated larger foreign objects sliding down the inclined conveyor 5 are, with the aid of a backup door 8, arranged at the bottom end of the inclined conveyor 5, first stopped and collected. Once the processing of the coin mix has been completed and the last coin 3 has cleared the stripper 6 and toppled on the chute 7, the direction of rotation of inclined conveyor 5 is briefly reversed (arrow c') and the door 8 opened simultaneously (arrow f). The accumulated, or backed-up, coarse foreign objects can then drop (arrow g) into a container (not shown).

As a first approximation, one should be able to assume that a denominationally clean coin mix is contained in the coin tray 2, at best along with some included foreign or counterfeit coins. Unfortunately, practice differs. It is found time and again that smaller foreign objects continue to proceed into the coin tray 2 and that also larger flat, e.g., elliptic parts, pass the stripper 6 and proceed into the coin tray 2.

To allow for these occurrences, a partial section 21 in the bottom area of the circular sidewall 20 is provided with smaller holes through which small foreign objects can exit due to centrifugal force (arrow h). Coordinated with the partial area 21 is a removable bin 9. In view of any larger foreign objects carried along, a swivel gate 10 (arrow i) is provided in a second partial section 22 of the circular sidewall 20, keeping the circular sidewall 20 closed during the operating cycle without leaving any gap or edge; gate 10 is after each counting or sorting of a coin mix opened briefly. The coin tray 2 is at the same time counterrotated briefly (arrow b'), ejecting larger foreign objects by way of gate 10 into a container.

With the present coin counting and/or sorting apparatus, all foreign objects have been separated. A further improvement provides for arranging in the bottom area of chute 7 and/or also in the area of stripper 6 a suction device 11 which removes dust and, as the case may be, shreds of paper or fabric. A further provision calls for arranging in the door 8, at the bottom end of the inclined conveyor 5, holes and/or slits through which liquid proceeding into the feed channel of inclined conveyor 5 can be removed.

Figure 2:
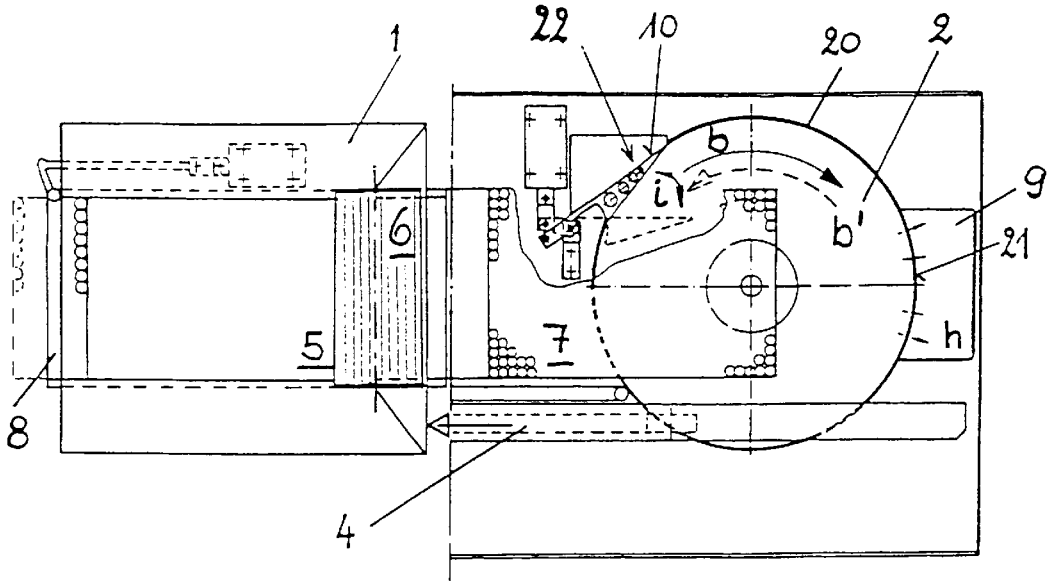
FIG. 2, is a top view of FIG. 1, viewed along line A—A.
Figure 3:
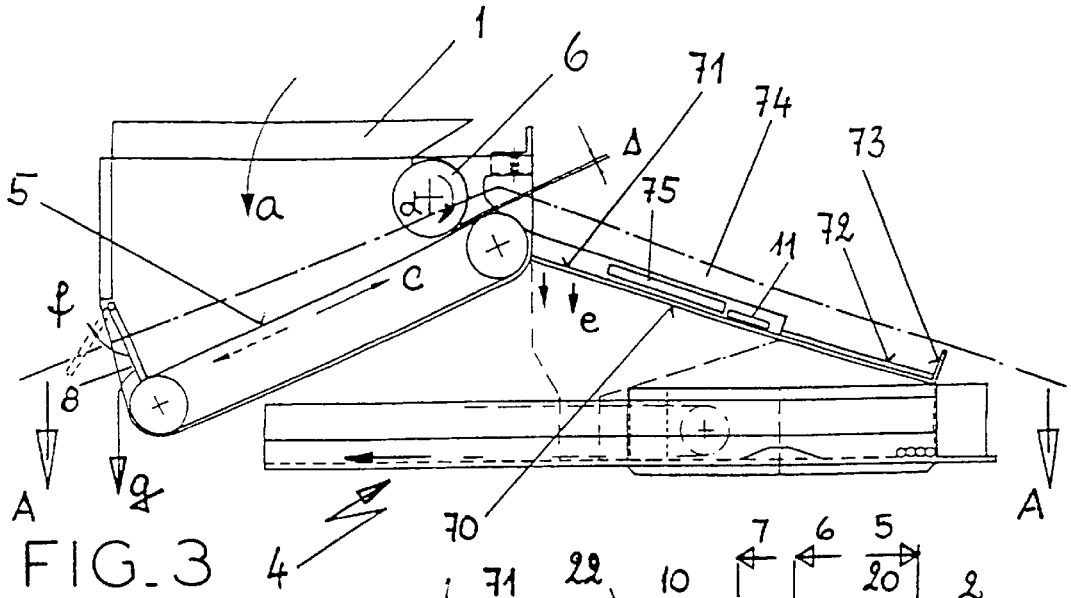
FIG. 3, is a second exemplary embodiment of the coin processing apparatus in a side elevational view.
Figure 4:
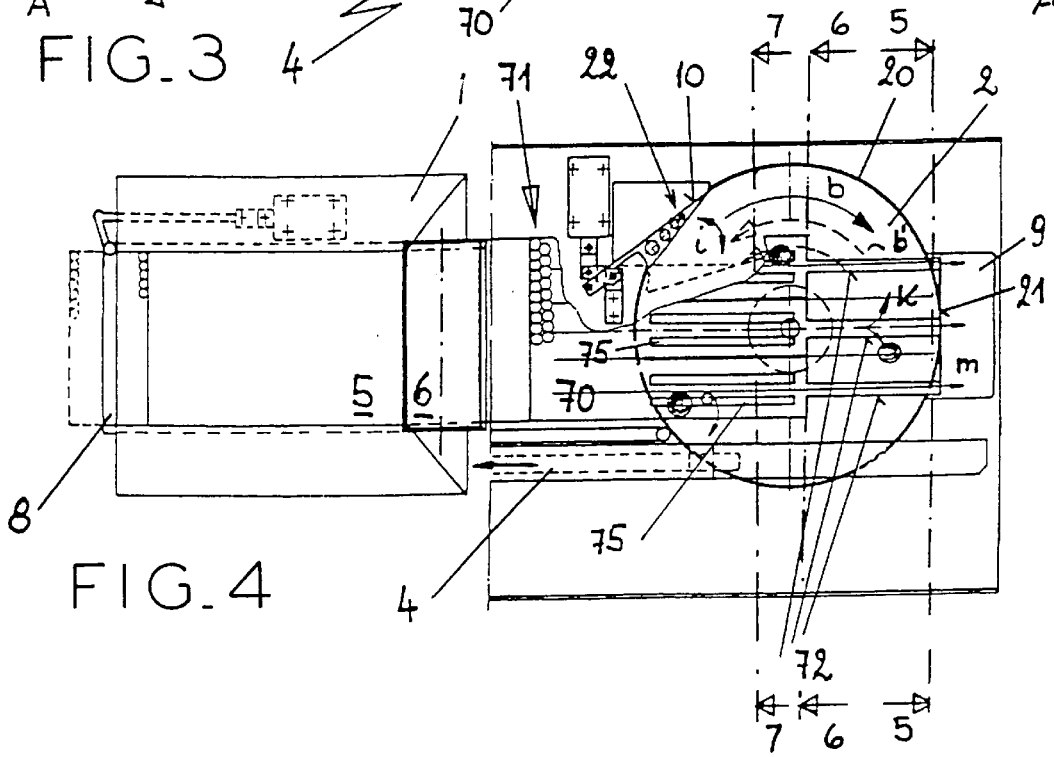
FIG. 4, is a top view of FIG. 3, viewed along line A—A.
Figure 5:
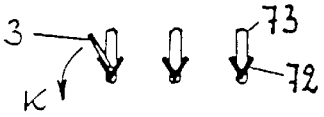
FIG. 5, is a sectional view taken along line 5—5 of FIG. 4 and viewed in the direction of the arrows.
Figure 6:
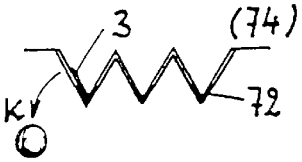
FIG. 6, is a sectional view taken along line 6—6 of FIG. 4 and viewed in the direction of the arrows.
Figure 7:
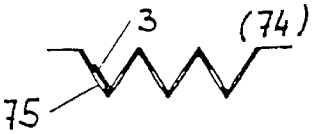
FIG. 7, is a sectional view taken along line 7–7 of FIG. 4 and viewed in the direction of the arrows.

FIG. 2 illustrates, with respect to the basic structure, the same apparatus as FIG. 1. The difference from the exemplary embodiment according to FIG. 1 is that the chute 70 transferring the coins 3 from the inclined conveyor 5 to the coin tray 2 is designed, or constructed, differently. Similar to the chute 7 (FIG. 1), chute 70 borders directly on the inclined conveyor 5 and receives the coins 3 passing the stripper roll 6, along with foreign objects or foreign substances. In the area adjoining the stripper roll 6, the chute 70 is fashioned as a perforated plate 71, analogous to the chute 7 according to FIG. 1.

The chute 70—in variation of that in FIG. 1—has its delivery end extended up to the circular sidewall 20 of the coin tray 2 up to the partial section 21 with the following bin 9 for smaller foreign objects. Chute 70 is in this end area fashioned such that several (presently three) V-shaped ducts 72 are created. The clearance between ducts 72 is such that even the largest coin 3 of the coin mix processed is allowed to drop through; the height of ducts 72 is selected such that the largest coins, and also the smallest, topple on account of the force of their dead weight over the edge of duct 72 (arrow k), while any smaller foreign objects that are carried along or slip off can slide down and proceed into the bin 9 (arrow m). To prevent any coin, notably such of small diameter, from slipping through over the duct 72 and dropping in the bin 9, the ducts 72 are closed off with arcuate elements 73 that allow the small foreign objects to pass, but hold the coins 3 back, causing them to drop into coin tray 2. These design details can be seen particularly in the cross sectional illustration I—I—coins 3 cannot pass, but topple over (arrow k), whereas flat, small objects, such as paper clips, pass the arcuate elements 73.

Between the entrance area of chute 70, fashioned as perforated plate 71, and the end area defined by the ducts 72, the design of chute 70 may be such that ducts 72 are across the width of chute 70 immediately adjacent, as shown in the cross-sectional illustration II—II. The coins 3 slide here from the intermediate area 74 into the ducts 72 and can then topple over.

Cut in the said intermediate area 74, in the V-shaped bounding walls, are oblong slots 75 that are smaller than the diameter of the smallest coin to be processed. Hence, smaller foreign objects are allowed to drop through the oblong slots 75, whereas the coins 3 are supported and continue on (refer to sectional drawing III—III).

| List of Elements | |
|---|---|
| 1 | Coin hopper |
| 2 | Coin tray |
| 3 | Coin |
| 4 | Guide section |
| 5 | Inclined conveyor |
| 6 | Stripper |
| 7 | Chute |
| 8 | Door |
| 9 | Bin |
| 10 | Gate |
| 11 | Suction device |
| 20 | Circular guide or sidewall |
| 21,22 | Partial section |
| 70 | Chute |
| 71 | Perforated plate |
| 72 | Duct |
| 73 | Arcuate element |
| 74 | Intermediate area |
| 75 | Oblong slot |

We claim:

1. An apparatus for processing coins or similar disk-like objects, comprising:

a coin hopper;

a coin tray including an exit leading to a coin counting or sorting section;

an inclined conveyor disposed between said hopper and said tray and positioned such that coins emptying from said hopper can be received onto a surface of said conveyor and fed by said conveyor in a feed direction, the tilt of said conveyor causing larger foreign objects to slide down said conveyor in a direction opposite to the feed direction of said conveyor;

a coin singularizing stripper disposed near a delivery end of said conveyor in close proximity to said surface of said conveyor; and a chute extending between the coin delivery end of said conveyor and said coin tray whereby coins from said conveyor are fed to said coin tray, said chute including a separator to separate coins from smaller foreign objects, wherein said chute, in an area near its delivery end, comprises at least one inclined V-shaped duct having oblong slots smaller than the diameter of the smallest coin to be processed, thereby allowing smaller foreign objects to drop through the slots, and wherein said duct has a sidewall sufficiently low to permit coins to topple thereover due to gravity yet sufficiently high to contain foreign objects as they slide down said duct.

2. An apparatus for processing coins or similar disk-like objects, comprising:

a coin hopper;

a coin tray including an exit leading to a coin counting or sorting section;

an inclined conveyor disposed between said hopper and said tray and positioned such that coins emptying from said hopper can be received onto a surface of said conveyor and fed by said conveyor in a feed direction, the tilt of said conveyor causing larger foreign objects to slide down said conveyor in a direction opposite to the feed direction of said conveyor;

a coin singularizing stripper disposed near a delivery end of said conveyor in close proximity to said surface of said conveyor;

a chute extending between the coin delivery end of said conveyor and said coin tray whereby coins from said conveyor are fed to said coin tray, said chute including a separator to separate coins from smaller foreign objects, wherein said chute, in an area near its delivery end, comprises at least one inclined V-shaped duct, wherein a lower end of said duct is closed off by an arcuate element adapted to retain coins yet allow smaller foreign objects to pass, said duct having a sidewall sufficiently low to permit coins to topple thereover due to gravity yet sufficiently high to contain foreign objects as they slide down said duct.

3. An apparatus for processing coins or similar disk-like objects, comprising:

a coin hopper;

a coin tray including an exit leading to a coin counting or sorting section;

an inclined conveyor disposed between said hopper and said tray and positioned such that coins emptying from said hopper can be received onto a surface of said conveyer and fed by said conveyor in a feed direction, the tilt of said conveyor causing larger foreign objects to slide down said conveyor in a direction opposite to the feed direction of said conveyor;

a coin singularizing stripper disposed near a delivery end of said conveyor in close proximity to said surface of said conveyor;

a chute extending between the coin delivery end of said conveyor and said coin tray whereby coins from said conveyor are fed to said coin tray, said chute including a separator to separate coins from smaller foreign objects, wherein said chute, in an area near its delivery end, comprises at least one inclined V-shaped duct having a sidewall sufficiently low to permit coins to topple thereover due to gravity yet sufficiently high to contain foreign objects as they slide down said duct; and a back-up door positioned at a lower end of said conveyor to capture the larger foreign objects that have slid down said conveyor, said door being openable to permit the captured foreign objects to drop into a collection container.

4. The apparatus of claim 3 wherein said door includes small openings adjacent said conveyor surface to allow liquid to drain away.

5. An apparatus for processing coins or similar disk-like objects, comprising:

a coin hopper;

a coin tray including an exit leading to a coin counting or sorting section;

an inclined conveyor disposed between said hopper and said tray and positioned such that coins emptying from said hopper can be received onto a surface of said conveyor and fed by said conveyor in a feed direction, the tilt of said conveyor causing larger foreign objects to slide down said conveyor in a direction opposite to the feed direction of said conveyor;

a coin singularizing stripper disposed near a coin delivery end of said conveyor in close proximity to said surface of said conveyor;

a chute extending between a delivery end of said conveyor and said coin tray whereby coins from said conveyor are fed to said coin tray, said chute including a separator to separate coins from smaller foreign objects; and a back-up door positioned at a lower end of said conveyor to capture the larger foreign objects that have slid down said conveyor, said door being openable to permit the captured foreign objects to drop into a collection container.

6. The apparatus of claim 5 wherein said door includes small openings adjacent said conveyor surface to allow liquid to drain away.

7. An apparatus for processing coins or similar disk-like objects, comprising:

a coin hopper;

a coin tray including an exit leading to a coin counting or sorting section, wherein said coin tray is rotatable and includes said exit, and wherein said coin tray sidewall is perforated in an area before said exit in direction of rotation, whereby smaller foreign objects are ejected by centrifugal force;

an inclined conveyor disposed between said hopper and said tray and positioned such that coins emptying from said hopper can be received onto a surface of said conveyor and fed by said conveyor in a feed direction, the tilt of said conveyor causing larger foreign objects to slide down said conveyor in a direction opposite to the feed direction of said conveyor;

a coin singularizing stripper disposed near a coin delivery end of said conveyor in close proximity to said surface of said conveyor; and a chute extending between the coin delivery end of said conveyor and said coin tray whereby coins from said conveyor are fed to said coin tray, said chute including a separator to separate coins from smaller foreign objects.

8. The apparatus of claim 7 wherein said coin tray sidewall includes an openable gate after the exit in the direction of rotation through which gate larger foreign objects that have remained in said coin tray pass upon reversing rotation of said coin tray.

9. An apparatus for processing coins or similar disk-like objects, comprising:

a coin hopper;

a coin tray including an exit leading to a coin counting or sorting section, wherein said coin tray is rotatable and includes a sidewall having said exit therein, and wherein said sidewall includes an openable gate after the exit in the direction of rotation through which gate larger foreign objects that have remained in said coin tray pass upon reversing rotation of said coin tray;

an inclined conveyor disposed between said hopper and said tray and positioned such that coins emptying from said hopper can be received onto a surface of said conveyor and fed by said conveyor in a feed direction, the tilt of said conveyor causing larger foreign objects to slide down said conveyor in a direction opposite to the feed direction of said conveyor;

a coin singularizing stripper disposed near a delivery end of said conveyor in close proximity to said surface of said conveyor; and a chute extending between a delivery end of said conveyor and said coin tray whereby coins from said conveyor are fed to said coin tray, said chute including a separator to separate coins from smaller foreign objects.

* * * * *